United States Patent [19]

Buel

[11] Patent Number: 4,550,929

[45] Date of Patent: Nov. 5, 1985

[54] SKI BOOT HEEL BINDING

[76] Inventor: G. Theodore Buel, 30 Market Sq., Knoxville, Tenn. 37902

[21] Appl. No.: 521,838

[22] Filed: Aug. 10, 1983

[51] Int. Cl.[4] ..... A63C 9/084

[52] U.S. Cl. ..... 280/614; 280/632

[58] Field of Search ..... 280/614, 631, 632, 633, 280/634, 615, 636, 613, 620

[56] References Cited

U.S. PATENT DOCUMENTS

| | | | |
|---|---|---|---|
| 3,985,371 | 10/1976 | Pyzel | 280/614 |
| 4,116,462 | 9/1978 | Buel | 280/614 |
| 4,269,430 | 5/1981 | Eie | 280/614 |
| 4,417,749 | 11/1983 | Näptlin | 280/614 |

FOREIGN PATENT DOCUMENTS

| | | | |
|---|---|---|---|
| 778302 | 2/1968 | Canada | 280/614 |
| 2342378 | 2/1975 | Fed. Rep. of Germany | 280/633 |

*Primary Examiner*—Joseph F. Peters, Jr.
*Assistant Examiner*—Joseph G. McCarthy
*Attorney, Agent, or Firm*—Emory L. Groff, Jr.

[57] ABSTRACT

A heel binding for ski boots cooperates with a boot heel plate for use in either alpine or cross-country skiing and includes a pivot member displaceable between locked and unlocked positions. In the locked position, during alpine skiing a forward shoulder on the pivot member engages the heel plate and resists upward thrust of the boot heel according to a selective biasing force as provided by a yieldable latch member engaging a first detent on a cam section of the pivot member. In the alternate unlocked position, for cross-country skiing, the pivot member is retained clear of the heel plate by engagement of the same latch member within a second detent on the pivot member cam section. The forward portion of the binding is constructed to engage within a mating recess in the heel plate and/or boot heel on each downward motion of the heel so as to guide the skier's foot into proper axial alignment with the ski. As a safety feature, the pivot member also is automatically displaced clear of the heel plate when the selected biasing force exerted by the latch member is overcome, such as during a fall.

11 Claims, 10 Drawing Figures

SKI BOOT HEEL BINDING

This invention relates generally to heel bindings for skis and more particularly to an improved binding usable in both a down-hill or cross-country skiing mode.

The requirements for heel bindings as used in the different types of skiing are well known to those skilled in the art. In the case of alpine or down-hill skiing, in addition to the usual toe binding, a heel binding is required which will insure that the rear of the skier's boot at all times remains fixedly secured atop the ski. Such devices incorporate suitable means, usually adjustable, which automatically releases the attachment of the boot heel when subjected to a sudden or unusual degree of force so as to provide the required safety feature to minimize injury to the skier when encountering a fall or unusual attitude. On the other hand, in the case of trail or cross-country skiing, the ski shoe or boot has often been attached to the ski only through a toe binding so that the heel of the boot may be vertically lifted from the ski during the normal striding motion of the skier when moving over level or slightly inclined terrain. The disadvantage of employing only a toe binding when cross-country skiing is that the skier is unable to employ the normal techniques of controlling speed and direction, such as the snow plough, stem-christie and christie turn, when the skier encounters a steep, decending slope during his travel.

An example of a heel binding adaptable for use with a trail ski will be found in U.S. Pat. No. 3,985,371 to Pyzel et al, issued Oct. 12, 1976 and which includes a displaceable member selectively engageable with the boot heel. Although the present invention may be used with both alpine and trail skis, it finds particular merit when used with trail skis in view of an improved construction allowing ready displacement between alternate modes and includes a simple arrangement whereby the tension or biasing means determining the force required for its release, may be easily altered. In one present embodiment, a simple tool is utilized to vary the tension of a compression spring acting upon a latch member, the latter of which constantly bears upon the cam face of a pivotal member adapted to alternately engage a boot heel plate or remain removed therefrom. In a second embodiment herein, the separate spring member is eliminated and the latch member itself is formed as an integral spring device constantly engaging the cam face of the binding pivotal member. Both embodiments include cooperating structure on the binding and boot heel insuring automatic axial alignment between the skier's foot and ski during each downward motion of the boot heel.

Accordingly, one of the objects of the present invention is to provide an improved ski boot heel binding including a forward wedge-shaped section engageable by a mating configuration carried by a ski boot heel with a pivotal member adapted to overlie and engage the area adjacent the boot heel together with a yieldable latch member adapted to retain the pivotal member in engagement with the boot heel atop the ski.

A further object of the present invention is to provide an improved ski boot heel binding including a pivotal member adapted to overlie and retain a ski boot heel upon a ski and which is held in the locked mode by a spring-urged latch member constantly engaging a cam surface on the pivotal member.

Still another object of the present invention is to provide an improved ski boot heel binding including a pivotal member adapted to overlie a ski boot heel to retain it atop the ski and an integral spring latch member normally retaining the pivotal member in the locked position with means allowing substitution of various such spring latch members to alter the force required to unlock the pivotal member.

With these and other objects in view which will more readily appear as the nature of the invention is better understood, the invention consists of the novel construction, combination and arrangement of parts hereinafter more fully described, illustrated and claimed.

Preferred and practial embodiments of the invention are shown in the accompanying drawings in which.

Similar reference characters designate corresponding parts throughout the several figures of the drawings.

Figure 1:
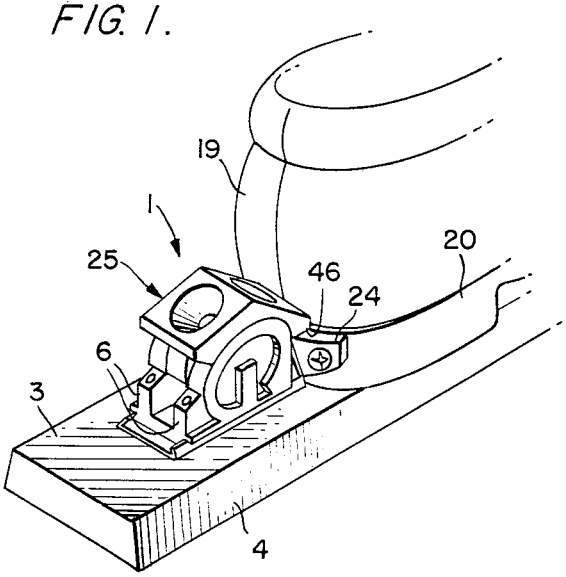
FIG. 1 is a fragmentary top perspective view illustrating a ski boot atop a ski equipped with the binding of the present invention.

Referring now to the drawings, particularly FIGS. 1–4, the heel binding 1 will be seen to comprise a main body 2 affixed to the top surface 3 of a ski 4. The main body 2 includes a substantially horizontal base 5 from which extend upwardly a pair of vertical side walls 6—6 defining a longitudinal channel 7 therebetween. The referenced fixture of the binding 1 to the ski 4 is readily achieved by employing a mounting track 8 comprising a planar base 9 and two lateral upstanding flanges 10—10 the latter of which are preferably slightly inclined inwardly. In this manner, by providing mating grooves or inclinations on the main body side walls 6 or edges of the base 5, the binding 1 may be initially slipped into an open end of the mounting track 8 and when properly longitudinally positioned therein, secured thereto by means of appropriate fasteners 11 inserted in threaded bores 12 in the two side walls 6. By this mechanism, upon tightening of the fasteners 11, the ends 13 thereof are brought to bear upon the top surface of the track base 9 to lock the heel binding 1 with respect to the mounting track and its underlying ski.

The front of the binding main body 2 provides a forward wedge-shaped nose section 14 comprising tapered side walls 15—15 bounded by a transverse, downwardly inclined lower face 16 and transverse, upwardly inclined upper face 17. This nose section is completed by a horizontal top wall 18 shown most clearly in FIG. 4 of the drawings. The aforedescribed configuration of the forward nose section 14 is adapted to cooperate with a suitable mating construction carried by the rear of the ski boot 19 in the area of its heel 20 so as to insure proper longitudinal alignment of the skier's boot and to prevent lateral displacement thereof when locked into the position shown in FIG. 3.

Figure 2:
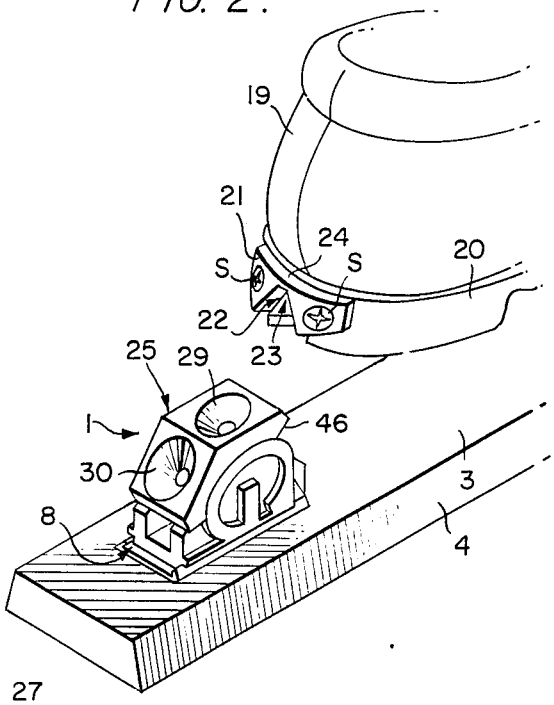
FIG. 2 is a view similar to FIG. 1 illustrating the heel binding in the unlocked position with the ski boot elevated.

The boot heel 20 will be seen from FIG. 2 to include a heel plate 21 attached such as by screws S to the heel 20. The mentioned orientation and lateral retaining means will be understood to comprise a notch or recess 22 formed in the heel plate which may communicate with a somewhat similarly configured notch or recess 23 formed in the adjacent portion of the boot heel 20. The heel plate notch 22 preferably falls short of extending through the top of the heel plate such that this heel plate offers a horizontally disposed top wall 24 intended to engage the top wall 18 of the binding nose section 14 when in the locked position of FIG. 3. When in this locked position, the side walls 15 and top wall 18 of the binding nose section 14 form a close mating fit within the confines of the heel plate notch 22 such that the skier's boot 19 is properly axially aligned with the longitudinal extent of the ski 4 and is prevented from any lateral displacement relative thereto. The inclined upper face 17 and the formed portion of the two side walls 15 additionally nest within mating configuration of the heel recess 23.

Shiftable means are provided to retain the ski boot in this locked position and comprises a pivot member 25 having a lower cam section 26 positioned within the main body channel 7 and which is preferably integral with an upper actuating section 27 the latter of which may extend above and overlie the top of the two main body side walls 6. The top 28 of the upper actuating section 27 is formed with a forward well or depression 29 and a rearward well or depression 30, the purpose of which, will be explained hereinafter.

Figure 3:
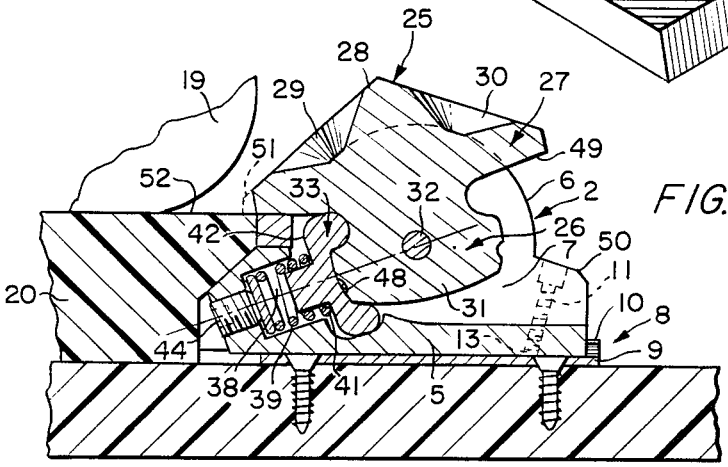
FIG. 3 is an enlarged longitudinal sectional view of the heel binding of FIG. 1.
Figure 4:
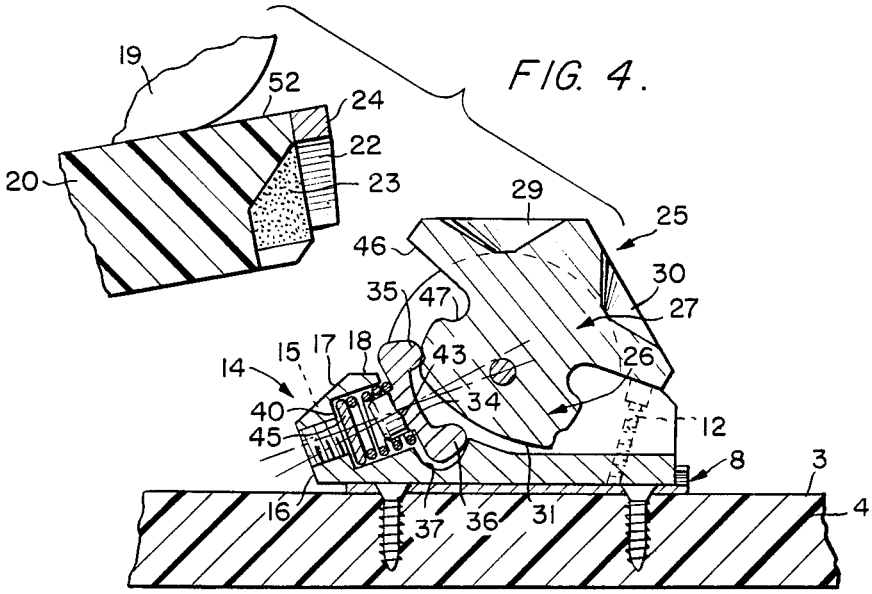
FIG. 4 is a view similar to FIG. 3 and illustrates the various components as they appear when in the released or unlocked condition.

The lower cam section 26 will be seen to be provided with an arcuate cam face 31 displaceable between the limits shown in FIGS. 3 and 4 of the drawings as the pivot member 25 is rotated about the pivot screw or shaft 32. This cam face 31 cooperates with a latch member, generally designated 33 and which includes a central body 34 and a lock nose 35 extending transversely of the cam face 31. A secondary nose 36 is substantially symmetrically disposed on the other side of the central body 34 of the latch member 33 and is normally cradled within a cavity 37 formed in the main body base 5. A recess 38 formed in the forward nose section 14 communicates with the channel 7 and serves to house biasing means such as the compression spring 39. One end of the spring 39 will be seen to constantly bear upon the base 40 of the recess 38 while the free end 41 of the spring constantly bears upon the rear surface 42 of the latch member 33 such that at all times, regardless of the angular displacement of the pivot member 25, it will be understood that a portion of the latch member will bear upon the lower cam section 26 of the pivot member 25.

A stud 43 projecting from the rear 42 of the latch member 33 is freely disposed within the coils of the spring 39 to assist in insuring its retention in the position shown in the drawings. Appropriate means are provided to allow variation of the biasing force as produced by the spring 39 upon the latch member 33 and may comprise a slotted or set screw 14 through its lower face 16. A spring plate 45 disposed in the bottom of the spring recess 38 supports the bottom convolution of the spring and is axially displaceable within the recess 38 upon manipulation of the adjusting screw 44 whereupon the convolutions of the spring will be compressed or expanded and its biasing force respectively altered.

With the foregoing structure in mind, it will be appreciated that the latch member lock nose 35 will be constantly biased against the cam face 31 of the pivot member 35 and when this pivot member is rotated to its forwardmost position with its forward retainer shoulder 46 abutting and overlying the heel plate top wall 24, the heel binding will be retained in this position due to the force of the spring 39 urging the latch member lock nose 35 into a first, transverse detent or locking means 47 formed in the cam face 31 adjacent the pivot member retainer shoulder 46.

Should an accident befall the skier when the binding is in the locked position of FIG. 3 of the drawings, any unusual amount of force upon the boot heel 20 will cause automatic displacement of the pivot member 25 toward the position as shown in FIG. 4. The foregoing situation covers the function of the present binding when serving as a safety feature. Alternatively, the skier may elect manually to unlock the binding from the secured position of FIG. 3, such as when it is desired to operate in a cross-country mode, in which case, the pivot member 25 is manually displaced from the position of FIG. 3 to that of FIG. 4. With this action, it will be seen that the ski boot heel is released to allow the normal striding motion attendant with cross-country operation. In this respect, a second smaller transverse detent 48 may be provided in the cam face 31 for reception of the lock nose 35 as shown in FIG. 4 so as to more positively retain the pivot member 25 in this open or unlocked position.

The aforementioned depressions 29–30 in the top 28 of the pivot member 25 facilitate the displacement of the heel binding between its alternate positions by providing spotting means for the receiption of the user's ski pole tip (not shown) Thus, it will be appreciated that by engaging the ski pole tip in the rear depression 30, the pivot member 25 is easily displaced from its locked position and conversely, by placing the ski pole tip in the forward depression 29 the pivot member may be readily moved from the unlocked to the locked position. The limit of rearward displacement of the pivot member 25 is further defined by abuttment of a rear stop shoulder 49 on the upper section 27 with the rear top walls 50 on the side walls 6, which abuttment occurs simultaneously with engagement of the lock nose 35 within the second detent 48.

FIGS. 5–10 depict an alternate embodiment wherein the heel binding 1' operates in a generally similar fashion as does the binding 1 but is constructed with a modified latch or spring member. The binding 1' includes a pivot member 55 having an upper actuating section 56 and a lower cam section 57. As shown most clearly in FIGS. 5 and 6 of the drawings, pivot member 55 is mounted for arcuate displacement with respect to a main body 58, the latter of which includes a base 59 from which project upwardly a pair of vertical side walls 60—60. The lower cam section 57 of the pivot member is disposed within a channel 61 formed between the two side walls 60—60 and is axially secured by means of a transverse pivot shaft such as the screw 62 shown most clearly in FIG. 7. The binding 1' is adjustably secured with respect to the underlying ski 4 by means of a releasable fastener 63 carried by the main body base 59 and which cooperates with a mounting track 8 as in the case of the first described embodiment.

The upper actuating section 56 of the pivot member 55 is provided with a rear stop shoulder 64 and an opposite forward retainer shoulder 65 which function in the same manner as the corresponding shoulders 46,49 of the heel binding 1. Accordingly, it will be understood that the ski boot secured by the binding 1' will be provided with an appropriate heel plate 66 suitably affixed to the rear of a heel such as by screws S. The heel plate 66 includes a wedge-shaped recess or notch 67 formed by a pair of inclined side walls 68—68 which will be understood to be angled downwardly and away from one another from the point of the heel plate top wall 69. The thus-formed heel plate notch 67 forms a close mating fit with the forward nose section 70 of the binding 1' so that when lowered as shown in FIGS. 5 and 6 of the drawings, the associated ski boot or shoe 19 will be axially aligned with the ski and precluded from transverse displacement during normal movement by the skier.

Figure 5:
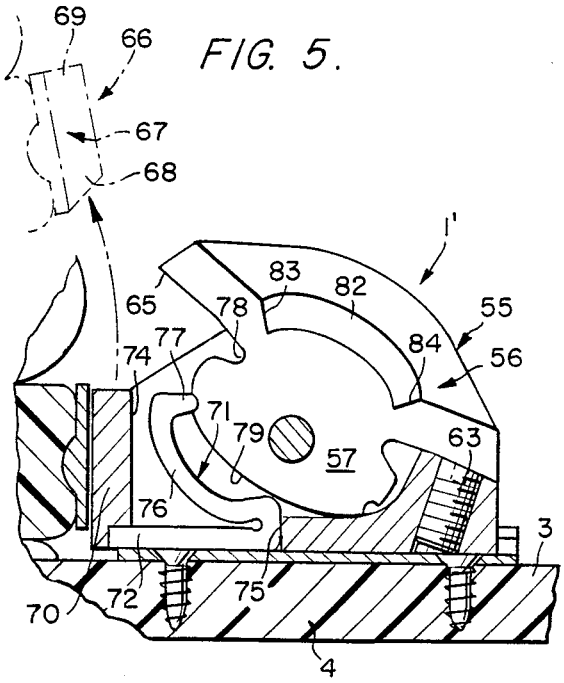
FIG. 5 is a view similar to FIG. 4 and illustrates an alternative embodiment.
Figure 6:
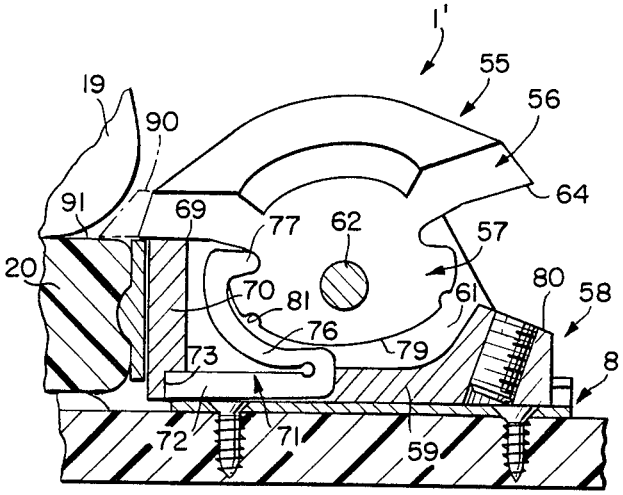
FIG. 6 is a view similar to FIG. 3 illustrating the embodiment of FIG. 5.
Figure 7:
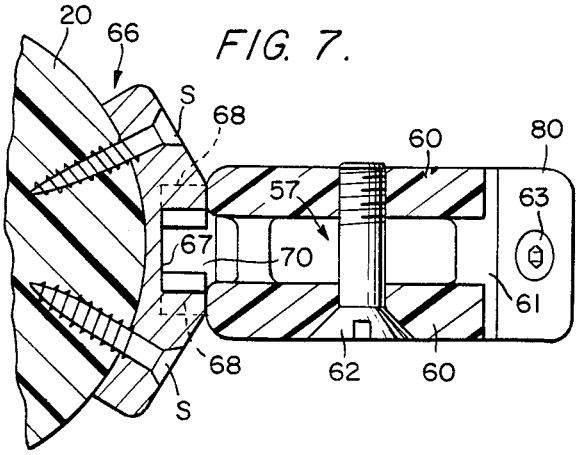
FIG. 7 is a horizontal sectional view of the binding of FIG. 6.
Figure 8:
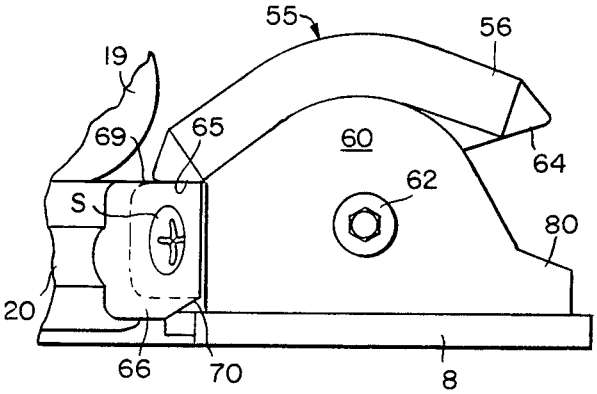
FIG. 8 is a side elevation of the binding of FIG. 6.
Figure 9:
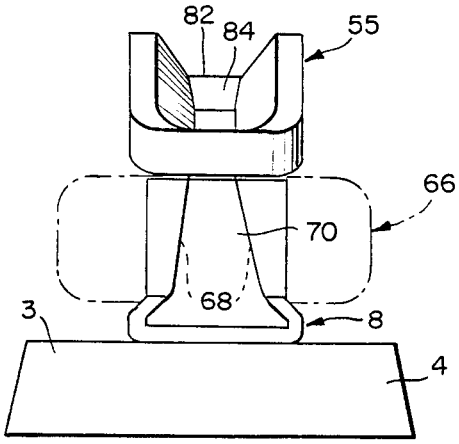
FIG. 9 is a front view of the binding of FIG. 8 with the heel plate shown in broken lines.

During down-hill or alpine skiing, the pivot member 55 is displaced from the position of FIG. 5 to that of FIG. 6 to lock the ski boot with respect to the ski and to prevent upward displacement of the boot during normal maneuvers. When arcuately displaced ot the position of FIG. 6, a forward retainer shoulder 65 on the upper actuating section 56 will be seen to overlie the top wall 69 of the heel plate 66 and this relationship is maintained by means of a latch or spring member 71 carried by the binding main body 58. In this embodiment, latch member 71 will be seen to comprise an integral spring device which is constructed of any suitable material such as metal or plastic. The latch member 71 includes a first arm 72 normally retained between a notch 73 formed on the rear wall 74 of the nose section and a forward wall 75 formed on the main body base 59. A second arm 76 projects upwardly from the rear of the first arm 72 and may be curved as shown in FIGS. 5 and 6 of the drawings. This second arm 76 terminates in a rearwardly projecting lock nose 77 adapted to be biased into the locked condition first detent or locking means 78 formed in the arcuate cam face 79 of the lower cam section 57.

The operation of the binding 1' is similar to that which was previously discussed in connection with the binding 1 whereby, when an unusual amount of force is applied upwardly by the heel plate 66, the top wall 69 thereof will bear upon the forward retainer shoulder 65 with a sufficient amount of force to overcome the predetermined biasing force retaining the latch member lock nose 77 within the first detent 78. As the ski boot heel plate 66 is raised to the broken line position of FIG. 5, the pivot member 55 of the binding is displaced to its full unlocked position whereupon the rear stop shoulder 64 abuts the rear top wall 80 of the main body 58. A second detent 81 provided in the lower cam section cam face 79 serves to retain the pivot member 55 in the unlocked position as the lock nose 77 of the latch member 71 is urged into this second detent.

In addition to the above automatic release from the locked condition of FIG. 6, the pivot member 55 may be selectively displaced such as when the ski is put on or taken off or when trail conditions vary and different skiing techniques are to be employed, such as during cross-country skiing. To facilitate this manipulation, the upper portion of the pivot member 55 is provided with a well or depression 82 having a front wall 83 and opposite rear wall 84. In this manner the skier's fingers may be utilized to displace the pivot member 55 or alternatively, a ski pole tip (not shown) can be placed within the well 82 and forced against either of the walls 83–84 to cause its pivotal displacement.

In the case of the heel binding 1, the degree of force required to cam the latch member 33 out of its engagement in the first locking detent 47 is, of course, determined by the adjustment provided through manipulation of the spring-tensioned adjustment screw 44. In most instances, alteration of the latch member biasing force is rarely necessary after a user has initially selected a release force to their liking. Thus, it will be appreciated that in the case of the second heel binding 1', a user will initially select a particularly latch member 71 exhibiting a specific biasing force and in this manner, be able to obtain a desired release point. Subsequent alteration of this release point may be readily achieved by simply replacing one latch 71 for another latch member offering a different biasing force.

Figure 10:
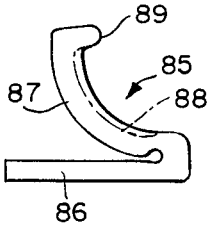
FIG. 10 is a side elevation of a replacement latch member useable in the embodiment of FIGS. 5–9.

FIG. 10 of the drawings illustrates an alternative latch member 85 having a first arm 86 from which extends upwardly a curved second arm 87 generally of the same configuration as the latch member 71 shown in FIGS. 5 and 6. A distinction is that at least a portion of the alternative latch member 85 is constructed of a material exhibiting a different degree of resilience, or if constructed of the same material, includes portions of thicker or thinner dimensions to provide a greater or lesser degree of resilience. In the example shown in FIG. 10, the profile of the latch member 71 of FIGS. 5–6 is shown by the broken line 88 and from this view it will be apparent that the member 85 includes portions of a greater dimension than the member 71 so that a greater biasing force is produced by its lock nose 89.

From the foregoing, it will be appreciated that an improved, simplified heel binding is presented which is particularly advantageous when employed in cross-country skiing. Although the annexed drawings illustrate a separate heel plate 21 or 66 carried by the rear of the boot heel, it will be understood that the heel plate may be omitted. In this latter instance, axial orientation is achieved in the same manner by utilization of a modified boot heel 20 provided with the notch or recess 23 as shown in FIGS. 2–4. The aligned boot heel is then secured in the locked position of FIG. 3 or 6 by a projection 51,90 on the pivot member 25,55 which will be seen to overlie the boot heel shelf 52,91 respectively.

Whether or not a heel plate is used, the present device offers an added advantage especially useful during ski touring. A skier may readily transition from a down-hill run to the striding mode of cross-country skiing without the need to stop and unlock the present binding by hand or ski pole tip merely by lifting the heel 20 with an added force such that the heel plate or top shelf of the heel arcuately displaces the pivot member rearwardly, against the biasing force of the latch member.

With either embodiment and whether or not a heel plate is employed, the forward nose portion 14 or 70 will be understood to automatically insure proper axial alignment of the skier's foot each time it is lowered to the ski, in view of the mating relationship between the binding nose portion and the recess or notch in the heel plate and/or heel.

I claim:

1. A binding carried by a ski and adapted to cooperate with a ski boot heel including, a binding main body having a base affixed atop a ski and provided with a forward nose section, a pivot member mounted above said base displacable between locked and unlocked positions, said pivot member having an upper actuating section and a lower cam section, wedge-shaped means adjacent the rear of the boot heel adapted to receive said forward nose section, said lower cam section including a cam face having locking means thereon, a rigid latch member, a spring engaging said rigid latch member to provide a biasing force to urge said latch member against said cam face, adjusting means manipulatable to alter the biasing force as provided by said spring, said spring and adjusting means disposed in said forward nose section, and a forward retainer shoulder on said pivot member upper actuating section adapted to overlie said heel wedge-shaped means when said pivot member is displaced to said locked position whereby, said latch member engages said locking means to maintain said locked position.

2. A heel binding according to claim 1 including, a configuration on said forward nose section substantially mating with said boot heel wedge-shaped means.

3. A heel binding according to claim 2 wherein, said forward nose section configuration includes a downwardly and forwardly inclined upper face joined to a pair of downwardly and outwardly inclined side walls.

4. A heel binding according to claim 1 wherein, said boot heel wedge-shaped means includes a heel plate provided with a notch therein.

5. A heel binding according to claim 4 including, a notch formed in said boot heel juxtaposed said heel plate notch.

6. A heel binding according to claim 1 wherein, said boot heel wedge-shaped means includes a notch formed in the boot heel.

7. A heel binding according to claim 1 including, a pair of side walls projecting upwardly form said main body base and defining a channel therebetween and a transverse pivot shaft mounting said pivot member lower cam section within said channel.

8. A heel binding according to claim 1 wherein, said latch member includes a lock nose urged against said cam face and said locking means comprises a detent in said cam face receiving said lock nose.

9. A heel binding according to claim 8 including, a second detent in said cam face engaged by said lock nose when said pivot member is displaced to said unlocked position.

10. A binding carried by a ski and adapted to cooperate with a ski boot heel including, a binding main body having a base affixed atop a ski and provided with a forward nose section, a pivot member mounted above said base displaceable between locked and unlocked positions, said pivot member having an upper actuating section and a lower cam section, wedge-shaped means adjacent the rear of the boot heel adapted to receive said forward nose section, said lower cam section including a cam face having locking means thereon, a latch member comprising an integral resilient member urged by a biasing force against said cam face, said resilient latch member including a first arm disposed within said main body base, a second arm projecting upwardly from said first arm, a lock nose on said second arm urged against said cam face and said locking means, and a forward retainer shoulder on said pivot member upper actuating section adapted to overlie said heel wedge-shaped means when said pivot member is displaced to said locked position whereby, said latch member engages said locking means to maintain said locked position.

11. A heel binding according to claim 10 including, a channel-shaped mounting track affixed to the ski adapted to longitudinally slidably receive said binding base and fastener means extendible through said base to said track to adjustably attach said main body relative said track.

* * * * *